US006181125B1

(12) United States Patent
Li et al.

(10) Patent No.: US 6,181,125 B1
(45) Date of Patent: Jan. 30, 2001

(54) COMBINATION APPARATUS OF A DISTRIBUTION TRANSFORMER AND SWITCHES

(76) Inventors: Shulin Li; Xujun Zhang, both of No. 115-204, Anhualu, Shanghai 200050 (CN)

( * ) Notice: Under 35 U.S.C. 154(b), the term of this patent shall be extended for 0 days.

(21) Appl. No.: 09/424,169

(22) PCT Filed: May 22, 1998

(86) PCT No.: PCT/CN98/00077

§ 371 Date: Jan. 27, 2000

§ 102(e) Date: Jan. 27, 2000

(87) PCT Pub. No.: WO98/53466

PCT Pub. Date: Nov. 26, 1998

(30) Foreign Application Priority Data

May 22, 1997 (CN) ..... 97104329

(51) Int. Cl.[7] ..... H01F 33/00
(52) U.S. Cl. ..... 323/361; 361/44
(58) Field of Search ..... 363/65; 323/361, 323/908, 215; 361/44, 62, 63, 80, 81, 87

(56) References Cited

U.S. PATENT DOCUMENTS 2,198,489 4/1940 Snyder et al. .
5,341,265 * 8/1994 Westrom et al. ..... 361/81 X
5,886,888 * 3/1999 Akamatsu et al. ..... 363/65

FOREIGN PATENT DOCUMENTS 0024934 3/1981 (EP) .
61-008645 3/1986 (JP) .

OTHER PUBLICATIONS

International Search Report for PCT/CN98/00077 completed Aug. 20, 1998.

* cited by examiner

*Primary Examiner*—Jessica Han
(74) *Attorney, Agent, or Firm*—Merchant and Gould P.C.

(57) ABSTRACT

A combination apparatus of distribution transformer and switch includes a distribution transformer with three-phase and five-column, wherein the arrangement of the low-voltage winding in $WYE_o$-form, the high voltage winding of each phase is connected in series with a high voltage fuse to constitute respectively one of the three high voltage phase arms, and the arrangement in high voltage side is DELTA form which is formed with one high voltage phase arm as one unit. The apparatus can be used in the system in which the neutral is not connected to the ground, or the neutral is connected to the ground through extinguishing-arc coil or through small resistance, and in the system in which the neutral is connected to the ground directly as well. It is possible that the fault phase does not disturb the normal operation of the other phases.

5 Claims, 2 Drawing Sheets

COMBINATION APPARATUS OF A DISTRIBUTION TRANSFORMER AND SWITCHES

TECHNICAL FIELD OF THE INVENTION

The present invention relates to a power distribution equipment, and more particularly to a combination apparatus of a distribution transformer and switches.

BACKGROUND OF THE INVENTION

At present, in China, the majority of power distribution cabinet are provided with a $\Delta/Y_0$ connected three-phase three-leg distribution transformer, while high voltage load switches, tapping switches, high voltage fuses (or circuit breakers) etc. are installed outside the sealed enclosure of the distribution transformer. As a result, the power distribution cabinet used in China has a larger volume, occupies more land and needs more maintenance. In the United States, an integrated power distribution cabinet, in which a $Y_0/Y_0$ connected three-phase five-leg distribution transformer is mounted, is popularly used, wherein the main bodies of high voltage load switches, tapping switches, and high voltage fuses are installed inside the sealed enclosure of the distribution transformer. Hence, the power distribution cabinet used in the United States has a smaller volume, occupies less land and needs less maintenance. However, the integrated power distribution cabinet has a disadvantage that it can not be used in a neutral non-grounded power system. Because in a neutral non-grounded power system, whether the transformer is connected in a $Y_0Y_0$ connection mode or in a $\Delta/Y_0$ connection mode, interrupting of one phase of high voltage fuse will cause the other two phases to have supply voltages far higher or far lower than the rated voltages thereof. It not only impairs the quality of power supply, but also probably causes damages of the user's electric apparatus as operating under such a higher voltage or lower voltage. For the time being, in China, a solution is to trip simultaneously all three phases artificially when an one-phase fault occurs. Obviously it is not very reasonable.

SUMMARY OF THE INVENTION

The object of the invention is to provide a combination apparatus of a distribution transformer and switches, which can be utilized both in a neutral grounded power system and in a neutral non-grounded power system. When high voltage fuses are interrupted upon an occurrence of a phase-to-ground fault or a phase-to-phase fault, the fault-free phases can operate in an normal power supply state, only the faulty phases being in a completely open state so that the combination apparatus of a distribution transformer and switches according to the invention has three phases that are non-mutual interferential.

To this end, the combination apparatus of a distribution transformer and switches according to the invention comprises an enclosure provided with low voltage bushings and high voltage bushings, in which a three-phase five-leg distribution transformer is disposed. The low voltage windings of the three-phase five-leg distribution transformer are connected in $Y_0$ connection mode, and the output terminals thereof are led out of the enclosure through the low voltage bushings serving as the low voltage output terminals of the combination apparatus. The high voltage windings of the three-phase five-leg distribution transformer are connected in series with at least a set of high voltage fuses to form three phases of high voltage phase-arms, and the three phases of high voltage phase-arms are connected in $\Delta$ connection mode. The high voltage output terminals of the combination apparatus are led out of the enclosure through the high voltage bushings from the connecting points of the three phases of high voltage phase-arms.

In order to improve the interruption capacity and the time-current characteristics of the high voltage fuses, two high voltage fuses having the same performances or different performances can be connected in serial in each high voltage phase-arm.

DETAILED DESCRIPTION OF THE PREFERRED EMBODIMENTS

Figure 1:
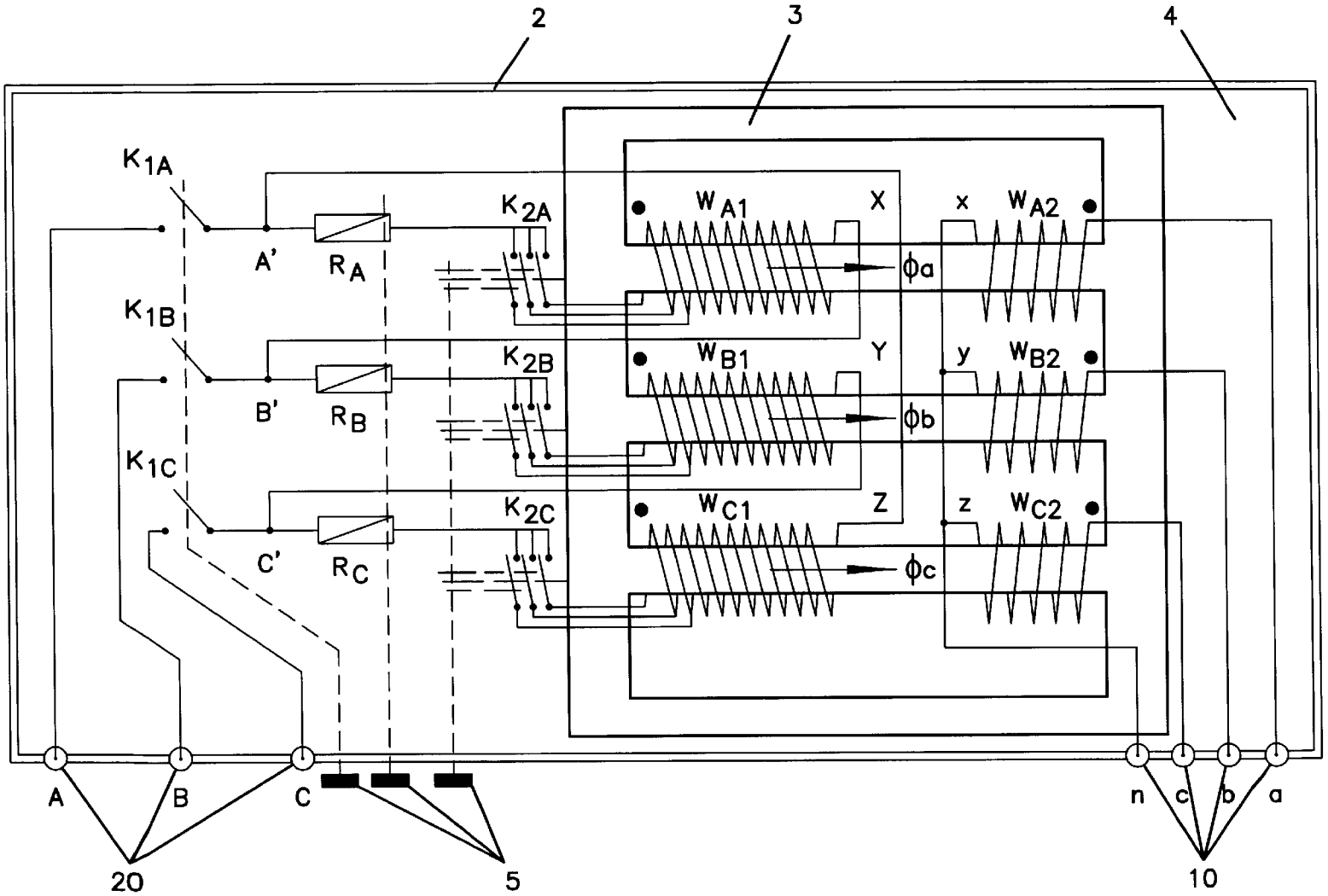
FIG. 1 shows schematically the structure of the combination apparatus of a distribution transformer and switches according to the invention.

FIG. 1 shows schematically the structure of the combination apparatus of a distribution transformer and switches according to the invention. As shown in FIG. 1, the combination apparatus of a distribution transformer and switches according to the invention comprises an enclosure 2 provided with low voltage bushings 10 and high voltage bushings 20, and a three-phase five-leg distribution transformer 2 disposed within the enclosure 2. The terminals of the low voltage windings $W_{A2}$, $W_{B2}$, $W_{C2}$ thereof are respectively indicated by reference numeral x, a; y, b; z, c, wherein the terminals x, y, z are directly connected together each other to form a terminal n as a ground terminal. In this way, the low voltage windings $W_{A2}$, $W_{B2}$, $W_{C2}$ are connected together in $Y_0$ connection mode. Through the low voltage bushings 10, low voltage output terminals of the combination apparatus are led out from the terminals a, b, c and n. The incoming terminals of the high voltage windings $W_{A1}$, $W_{B1}$, $W_{C1}$ of the three-phase five-leg distribution transformer 3 are respectively connected to the first terminals of a set of tapping switches $K_{2A}K_{2B}$, $K_{2C}$, while the second terminals of the set of tapping switches $K_{2A}$, $K_{2B}K_{2C}$ are respectively connected to the first terminals of a set of high voltage fuses $R_A$, $R_BR_C$. The second terminals A', B', C' of the set of high voltage fuses $R_1$, $R_B$, $R_C$ are respectively connected to the outcoming terminals Z, X and Y of the high voltage windings $W_{C1}$, $W_{A1}$, $W_{B1}$. Further, the terminals A', B', C' are respectively connected to the fist terminals of the high voltage load switches $K_{1A}$, $K_{1B}$, $K_{1C}$, while the second terminals A, B, C of the high voltage load switches $K_{1A}$,$K_{1B}$, $K_{1C}$ are respectively led out the enclosure 2 through the high voltage bushings 20 serving as the high voltage input terminals of the combination apparatus. The above connecting mode is so-called $\Delta/Y_0$ connection mode, wherein $\Delta/Y_0$-11 connection mode is preferably. The high voltage windings $W_{A1}$, $W_{B1}$, $W_{C1}$, the tapping switches $K_{2A}$, $K_{2B}$, $K_{2C}$ and the high voltage fuses $R_A$, $R_B$, $R_C$ connected respectively in serial form three phases of high voltage phase-arms A'X, B'Y, C'Z. In fact, in the three-phase five-leg distribution transformer 3, the $\Delta$ connection mode is formed by connecting in sequence the high voltage phase-arms A'X, B'Y, C'Z. Furthermore, the enclosure 2 is filled with insulation media 4 so as to ensure sufficient insulation strength.

The high voltage fuses $R_1$, $R_B$, $R_C$ of the combination apparatus of a distribution transformer and switches according to the invention are preferably overload fuses.

Further, the manual operating mechanisms of the tapping switches $K_{2A}$, $K_{2B}$, $K_{2C}$ and the high voltage load switches $K_{1A}$, $K_{2B}$, $K_{2C}$ as well as the fuse element 5 of the high voltage fuses $R_A$, $R_B$, $R_C$ are disposed outside the enclosure 2 of the combination apparatus of a distribution transformer and switches so as to the operated and maintained conveniently.

The following discusses are focused on the operations of the combination apparatus of a distribution transformer and switches according to the invention when a fault occurs. First of all, a single phase fault is discussed. When a phase-to-ground fault occurs at the high voltage winding $W_{A1}$ of the three-phase five-leg distribution transformer 3, the A-phase of high voltage fuse $R_A$ is interrupted, and thus the high voltage winding $W_{A1}$ loses its exciting current, while the high voltage windings $W_{B1}$, $W_{C1}$ of the sound phases B and C are still fed with normal rated voltages from the three-phase power supply, wherein the corresponding fluxes ϕb and ϕc form a loop respectively through the two side legs. Since the low voltage winding $W_{A2}$ of the phase A is connected with a load impedance, the synthetic flux of the fluxes ϕb and ϕc can hardly flow back through the leg of phase A, and hence the induction voltage on the low voltage winding $W_{A2}$ is very small. Therefore, under the condition of the fuse $R_A$ being interrupted, the phase A-to-ground voltage Ua0 output from the low voltage side of the three-phase four-line power system is approximately zero, while the sound phases B and C can still output rated voltages.

Hereinafter, a two-phase fault is discussed. When a fault occurs on the high voltage windings $W_{A1}$ and $W_{B1}$ of the three-phase five-leg distribution transformer, the high voltage fuses $R_A$ and $R_B$ of the phases A and B are interrupted, and thus the high voltage windings $W_{A1}$ and $W_{B1}$ lose the exciting current thereof, while the high voltage winding $W_{C1}$ of the sound phase C is still fed with normal rated voltages from the three-phase power supply, wherein the corresponding flux ϕc forms a loop through the two side legs. Since the low voltage windings $W_{A2}$ and $W_{B2}$ of the phases A and B are connected with load impedance, the flux ϕc cna hardly flow back through the legs of phases A and B, and hence the induction voltage on the low voltage windings $W_{A2}$ and $W_{B2}$ of the faulty phases are very small. Therefore, under the condition of the fuses $R_A$ and $R_B$ of the phases A and B being interrupted, the phase A-to-ground voltage Ua0 and the phase B-to-ground voltage Ub0 output from the low voltage side of the three-phase four-line power system are approximately zero, while the sound phase C can still output a rated voltage.

Figure 2A:
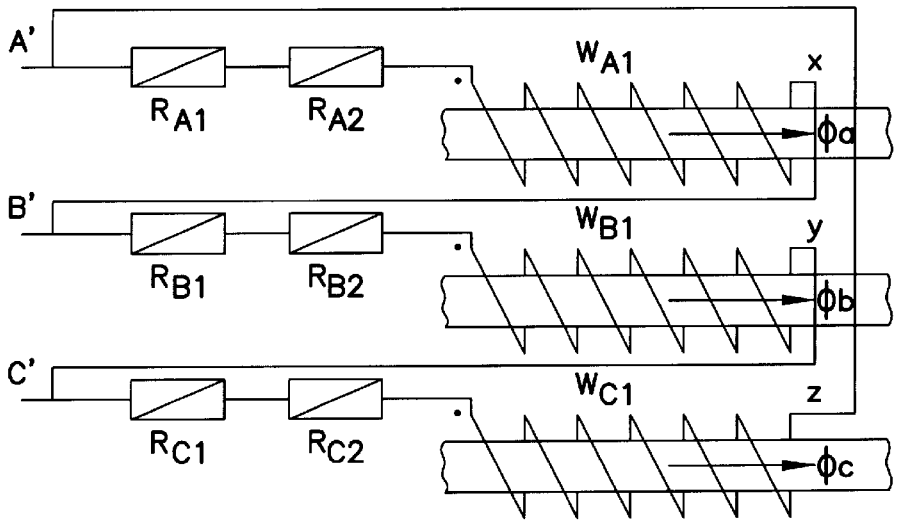
FIGS. 2*a* and 2*b* schematically show the connections of two sets of high voltage phase-arms of the combination apparatus of a distribution transformer and switches according to the invention, respectively, wherein two sets of high voltage fuses are connected in different ways.
Figure 2B:
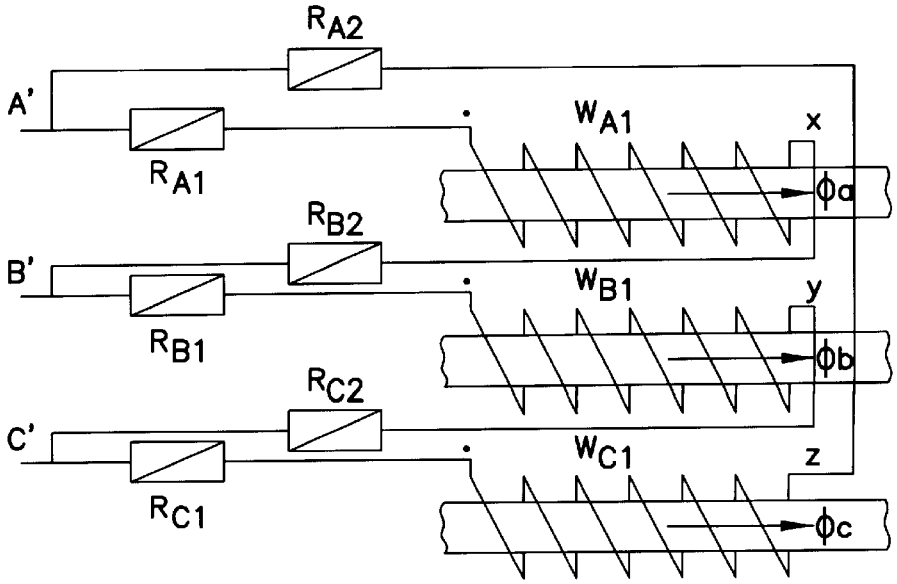

Of course, if necessary, two or more sets of high voltage fuses can be connected in series in the high voltage phase-arms of the combination apparatus of a distribution transformer and switches according to the invention. FIG. 2*a* and FIG. 2*b* schematically show two different connections between three phases of high voltage phase-arms of the combination apparatus of a distribution transformer and switches according to the invention, in which two sets of high voltage fuses are connected in series. In FIG. 2*a*, in the high voltage phase-arm of phase A, two high voltage fuses $R_{A1}$ and $R_{A2}$ in serial are connected at the incoming terminal of the high voltage winding $W_{A1}$. Similarly, in the high voltage phase-arms of phases B and C, two high voltage fuses in serial $R_{B1}$, $R_{B2}$ and $R_{C1}$, $R_{C2}$ are connected respectively at the incoming terminals of the high voltage windings $W_{B1}$ and $W_{C1}$. The two high voltage fuses connected in series in each high voltage phase-arm may be the same or different. Preferably, the high voltage fuses $R_{A1}R_{B1}$, $R_{C1}$ are current-limiting fuses and the high voltage fuses $R_{A2}$, $R_{B2}$, $R_{C2}$ are overload fuses having better inverse time-current characteristics.

The connection relations of the three phases of high voltage phase-arms of the combination apparatus of a distribution transformer and switches as shown in FIG. 2*b* are similar to those in FIG. 2*a*. The difference only lies in that the set of high voltage fuses $R_{A1}$, $R_{B1}$, $R_{C1}$ are respectively connected in serial at the incoming terminals of the high voltage windings $W_{A1}$, $W_{B1}$, $W_{C1}$, while the other set of high voltage fuses $R_{A2}$, $R_{b2}$, $R_{C2}$ are respectively connected in serial at the outcoming terminals of the high voltage windings $W_{A1}$, $W_{B1}$, $W_{C1}$.

The combination apparatuses of a distribution transformer and switches provided with the high voltage phase-arms as shown in FIG. 2*a* and FIG. 2*b* have operation states similar to the above. Further descriptions are omitted.

INDUSTRIAL APPLICABILITY

The combination apparatus of a distribution transformer and switches according to the invention can be utilized in either a neutral non-grounded power system or a power system whose neutral is grounded through arc-suppression coils or little resistors, and futher it can be utilized in a power system whose neutral is directly grounded. Because the high voltage fuses are serially connected in the three phase of high voltage phase-arms connected in a Δ connection mode, it can be ensured that the normal power supply of the sound phases are not interfered by faulty phases so that the reliability of the power supply can be improved.

What is claimed is:

1. A combination apparatus of a distribution transformer and switches, comprising an enclosure (2) provided with low voltage bushings (10) and high voltage bushings (20), and a three-phase five-leg distribution transformer (3) disposed in said enclosure (2), wherein the low voltage windings ($W_{A2}$, $W_{B2}$, $W_{C2}$) of said three-phase five-leg distribution transformer (3) are connected in wye $Y_0$ connection mode, and the output terminals thereof are led out of said enclosure (2) through said low voltage bushings (10) serving as the low voltage output terminals of said combination apparatus;

characterized in that high voltage windings ($W_{A1}$, $W_{B1}$, $W_{C1}$) of said three-phase five-leg distribution transformer (3) are connected in series with at least a set of high voltage fuses ($R_A$, $R_{A1}$, $R_{A2}$; $R_B$, $R_{B1}$, $R_{B2}$, $R_{C1}$, $R_{C2}$) so as to form three phases of high voltage phase-arms, and said high voltage phase-arms are connected in delta Δ connection mode, the high voltage input terminals of said combination apparatus being led out of said enclosure (2) through said high voltage bushings (20) from the connecting points of said three phases of high voltage phase-arms.

2. A combination apparatus of a distribution transformer and switches as claimed in claim 1, characterized in that said high voltage fuses are overload fuses.

3. A combination apparatuses of a distribution transformer and switches as claimed in claim 2, characterized in that a set of current-limiting fuses are further serially connected in said three phases of high voltage phase-arms.

4. A combination apparatus of a distribution transformer and switches as claimed in claim 1, characterized in that said high voltage fuses are current-limiting fuses.

5. A combination apparatus of a distribution transformer and switches as claimed in claim 1, characterized in that said high voltage phase-arms are connected in $\Delta/Y_0$-11 connection mode.

* * * * *